United States Patent [19]

Braymer, Jr. et al.

[11] 4,274,543

[45] Jun. 23, 1981

[54] VIAL AND CLOSURE STRUCTURE

[75] Inventors: George W. Braymer, Jr., Ross Township; Kalamazoo County, MI; Stephen H. Diaz, Los Altos, Calif.

[73] Assignee: The Upjohn Company, Kalamazoo, Mich.

[21] Appl. No.: 871,398

[22] Filed: Jan. 23, 1978 (Under 37 CFR 1.47)

[51] Int. Cl.[3] ..... B65D 81/32

[52] U.S. Cl. ..... 215/6; 215/249; 215/354

[58] Field of Search ..... 215/6, 247, 248, 249, 215/354, 251, ; 128/272.1; 206/219, 220, 221, 363; 220/257

[56] References Cited

U.S. PATENT DOCUMENTS

| | | | |
|---|---|---|---|
| 2,869,745 | 1/1959 | Lockhart | 215/247 |
| 2,908,274 | 10/1959 | Bujan | 215/247 |
| 3,087,638 | 4/1963 | Loper | 215/354 |
| 3,144,151 | 8/1964 | Grass | 206/221 |
| 3,379,326 | 4/1968 | Andersen | 215/249 |
| 3,464,414 | 9/1969 | Sponnoble | 206/219 |
| 3,977,555 | 8/1976 | Larson | 206/363 |
| 4,089,432 | 5/1978 | Crankshaw | 215/6 |
| 4,180,173 | 12/1979 | Diaz | 215/6 |
| 4,194,640 | 3/1980 | Crankshaw et al. | 215/6 |

FOREIGN PATENT DOCUMENTS

| | | | |
|---|---|---|---|
| 935117 | 8/1968 | United Kingdom | 220/266 |

*Primary Examiner*—Herbert F. Ross

*Attorney, Agent, or Firm*—Blanchard, Flynn, Thiel, Boutell & Tanis

[57] ABSTRACT

A closure structure for a two-compartment vial or container wherein a lyophilized medication is contained in one compartment and a solvent is contained in the other compartment. A displaceable, moisture-proof plug is removably disposed within a constriction between the two compartments. The closure structure includes a stopper which is partially inserted into the neck of the vial and a cap having a portion for fastening the cap to the vial neck. The cap has a cup portion of reduced diameter which snugly surrounds the protruding portion of the stopper and is disconnectible from the fastening portion in order to move with the protruding portion of the stopper into the neck of the vial under manually applied pressure. The cup portion is then removed so that the needle of a syringe can be inserted through the stopper to communicate with the interior of the vial.

12 Claims, 8 Drawing Figures

VIAL AND CLOSURE STRUCTURE

BACKGROUND OF THE INVENTION

This invention relates in general to a closure structure for a vial whereby accidental contamination of the contents of the vial is positively prevented and, more particularly, to a closure structure for a two-compartment vial in which a lyophilized medication and a solvent can be held in complete independence from each other until it becomes desirable to use the medication.

Two-compartment vials of the kind disclosed herein have been made and have been in common use for packaging and mixing medications for many years. However, such use has been frequently and continuously interrupted by problems. For example, early two-compartment vials were equipped with rubber center plugs which did not furnish moisture-proof barriers. Accordingly, the resultant seepage of the solvent into the lyophilized medication prevented the package from having the desired shelf-life. This problem was eventually overcome after considerable experimentation which resulted in the enclosed U.S. Pat. No. 3,464,414 entitled: *MIXING VIAL CONSTRUCTION.*

However, a further problem continued to persist and it concerned the closure structure. More specifically, it has been difficult at best to dislodge the center plug from between the compartments, by manually depressing the stopper which is partially inserted into the neck of the vial, so that the solvent could be mixed with the medication. That is, the projecting portion of the stopper tends to bulge radially outwardly when it is urged into the neck and therefore positively and vigorously opposes movement of the stopper into the neck. Thus, the harder the stopper is pushed into the vial, the more aggravated the problem becomes.

If the stopper is made from less flexible material, in order to minimize the bulging, then leakage of the solvent past the stopper readily occurs. That is, it is extremely difficult to hold close tolerances in the inside diameter of the neck of the vial and the outside diameter of the stopper, within reasonable cost limitations. By using a relatively soft rubber stopper, having an oversized diameter, it is possible to absorb large tolerances and still prevent leakage.

In existing closure structures for the same purpose, the outer free end of the stopper is often exposed to atmosphere, hence contamination, which can contaminate the needle of the syringe as it is moved through the stopper into the vial to withdraw the mixed materials therein. That is, the syringe must pass through the surface of the stopper which has been manually engaged by the hand of the user.

Finally, existing closure structures of this type are usually in two pieces, one comprising a removable stopper cap and the other comprising a ferrule which prevents accidental removal of the stopper from the vial. Usually, these two parts are made from dissimilar materials and assembled in two steps.

Accordingly, a primary object of this invention is the provision of a closure structure including a relatively soft and resiliently flexible stopper and a cap member having a fastening portion mounted upon the neck of a vial and an integral reduced portion closely surrounding the part of the stopper extending out of the neck of the vial, said reduced portion being movable with the stopper relative to the fastening portion and the neck of the vial.

A further object of this invention is the provision of a closure structure, as aforesaid, wherein the fastening portion is positively prevented from accidentally dislodging itself from the neck of the container.

A further object of this invention is the provision of a closure structure, as aforesaid, requiring a minimum of force applied to said cap member to displace the center plug.

Other objects and purposes of this invention will become apparent to persons familiar with this type of equipment upon reading the following description and examining the accompanying drawings, in which.

Also enclosed are copies of four additional patents, which are briefly distinguished from the invention as follows:

The Lockhart U.S. Pat. No. 2,695,614 discloses a two-compartment vial having a resiliently flexible stopper, but there is no rigidifying sleeve therearound.

The Bujan U.S. Pat. No. 2,908,274 discloses a resilient stopper surrounded by a sleeve, but the sleeve is independent and spaced from the bottle-engaging ferrule so that contamination can readily occur therebetween. Because of its particular structure, assembly of the parts is considerably more complicated in Bujan than in the subject invention.

In the Hayes U.S. Pat. No. 3,073,471, the embossment does not encase any part of the stopper and is merely disposed of after it is broken loose from the ferrule.

In the Parker U.S. Pat. No. 3,081,899, there is no resiliently flexible stopper encased by a cup.

Accordingly, it is believed tht the foregoing patents, as well as the aforesaid U.S. Pat. No. 3,464,414, are distinguishable from the claims in this application.

Figure 1:
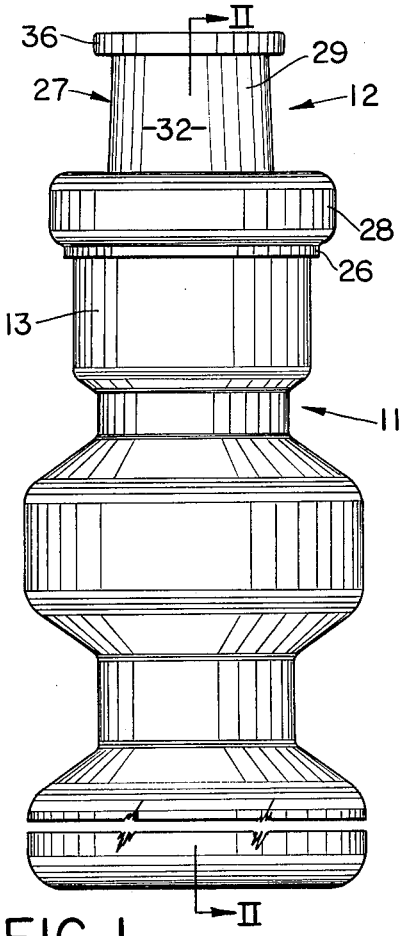
FIG. 1 is a side elevational view of a vial or container equipped with a closure structure embodying the invention.

For convenience in description, only, the terms "upper," "lower" and words of similar import will have reference to the invention and parts thereof as appearing in FIG. 1. The terms "inner," "outer" and derivatives thereof will have reference to the geometric center of said container and parts thereof.

SUMMARY OF THE INVENTION

The objects and purposes of the invention, including those set forth above, have been met by providing a closure structure for a two-compartment vial wherein a substantially cylindrical, elastomeric stopper is partially inserted into the neck of the vial and then covered by a cap means comprising a first portion secured to the neck and a second reduced portion snugly surrounding the outer portion of the stopper which extends from the vial. A vial and closure structure of this general type is jointly claimed in a copending application by one of the inventors herein and a third inventor, such application being Ser. No. 794,348, now U.S. Pat. No. 4,089,432.

DETAILED DESCRIPTION

The two-compartment vial 11 and closure structure 12, shown in FIG. 1, which illustrates a preferred embodiment of the invention, are substantially permanently interconnected. The vial 11 has a neck 13, a lower compartment 14 and an upper compartment 16 which compartments are separated by a constriction 17 into which a moisture barrier or plug 18 (FIG. 2) is inserted during the filling operation. The neck 13, in this embodiment, is separated from compartment 16 by second constriction 21, which serves to limit inward movement of the stopper 20. The neck 13 may under some circumstances have a smaller inside diameter than one or both of the compartments 14 and 16. The neck 13 has an outwardly projecting, annular rim 19 encircling its upper end.

In one particular utilization of the invention, a lyophilized medication is placed in the lower compartment 14 and the upper compartment 16 is filled with a solvent.

The closure structure 12 is comprised of a resiliently flexible stopper 20 which is preferably an elongated cylinder fabricated from an elastomer which is impervious to the solvent contained in the upper chamber. Said stopper has a deep recess 22 in the inner end thereof so that a needle 23 (FIG. 6) of a conventional syringe can be inserted axially through the stopper with relative ease.

The stopper 20 has a portion 24 of increased diameter which is disposed within the neck of the container 11.

The cap member 27, which partially surrounds the stopper 20, may be made in one piece by molding from a plastic, such as polyethylene, so that it has some resilience and some flexibility, but is relatively rigid. The cap member 27 has a lower skirt 28 which extends downwardly over and around the upper end of the neck to a plane somewhat below the lower edge of the rim 19.

Initially, the skirt 28 is substantially cylindrical. However, during assembly of the cap member upon the vial, the lower edge 26 of the skirt 28 is heated and formed snugly against the lower side of the rim 19 and the adjacent portion of the neck 13. The cap member 27 has an inverted cup 29 of reduced diameter and a flat, radially disposed ring 33 which extends between and is connected to the lower edge 31 of the cup 29 and upper end of the skirt 28. The ring 33 has an inside diameter smaller than the outside diameter of the stopper lower portion, whereby accidental removal of the stopper 20 from the vial 11 is positively opposed.

The distance between the lower surface of the ring 33 and the inwardly pressed, lower edge 26 of said skirt 28 is preferably equal to the thickness of said rim 19 in a direction axially of the container. Thus, said rim is thereafter firmly gripped between said skirt lower edge and said ring 33, whereby to strongly resist separation of the cap member 27, hence the entire closure 12, from the container 11.

Figure 2:
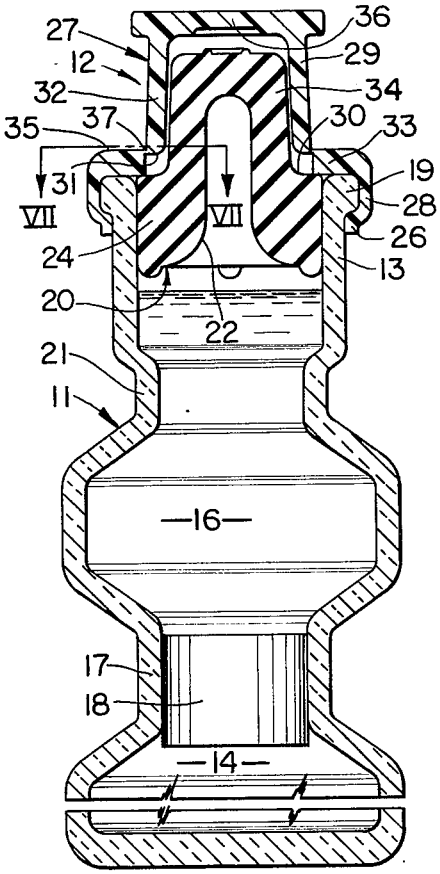
FIG. 2 is a sectional view taken along the line II—II in FIG. 1.
Figure 3:
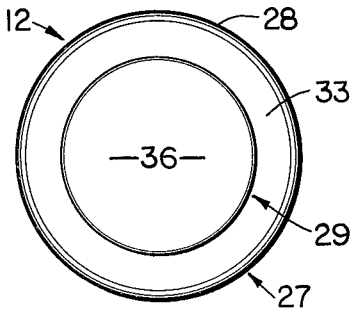
FIG. 3 is a top view of the closure structure.
Figure 4:
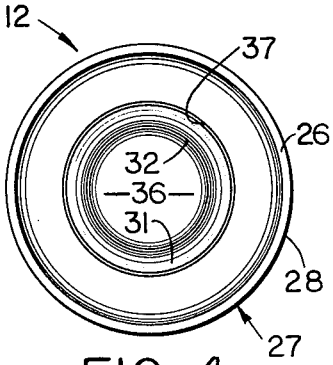
FIG. 4 is a bottom view of the cap member of the closure structure.
Figure 5:
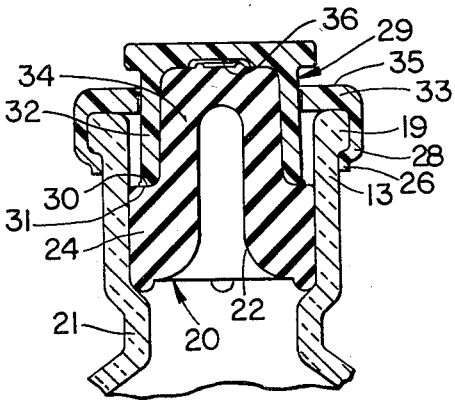
FIG. 5 is a fragment of FIG. 2 with the stopper and the cup portion of the closure structure depressed into the neck of the vial.
Figure 6:
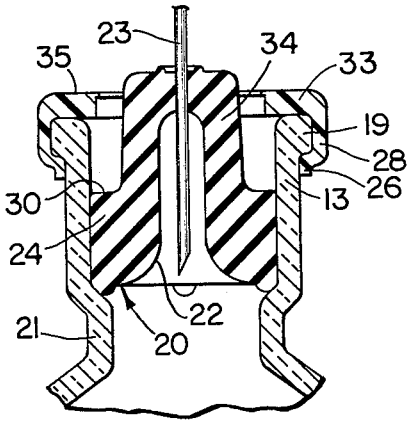
FIG. 6 is a fragmentary view similar to FIG. 5 showing the cup removed and the needle of a syringe extending through the stopper and into the vial.

The cup 29 has a substantially cylindrical side wall 32 which closely surrounds the upwardly projecting or extending portion 34 of the stopper 20, as shown in FIGS. 2, 5 and 6. Preferably, said side wall 32 extends somewhat beyond the upper axial end of the stopper 20 and has an integral end wall 36 which projects laterally of the side wall, whereby to engage the upper surface 35 of the ring 33 and thereby limit downward movement of said cup 29, hence the stopper 20. The stopper is substantially totally enclosed within said cap member and the upper end of the vial 11 when the closure 12 is mounted on the vial.

Figure 7:
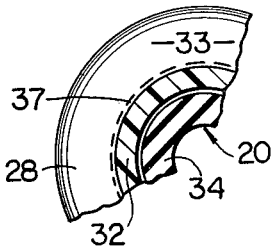
FIG. 7 is a fragmentary sectional view taken along the lien VII—VII in FIG. 2.

The cup 29 (FIGS. 2 and 7) is connected to the ring 33 by a thin narrow web 37 of the cap material which can be readily manually broken by pressing the stopper 20 and cup 29 toward the vial 11. The web 37, as well as the lower edge 31 of the side wall 32, are located adjacent the plane defined by the upper surface 35 of the ring 33. The lower edge 31 of the side wall 32 is spaced upwardly from the upper face of the shoulder 30 on the stopper 20, slightly less than the distance that the side wall 32 projects above the upper portion of the stopper 20.

OPERATION

The operation of the aforesaid structure is probably apparent from the foregoing description. However, a brief summary of such operation will now be given.

The lower chamber 14 of the vial 11 is filled with medication (not shown), a center plug 18 is inserted in the constriction 17 and solvent (not shown) is deposited in the upper chamber 16, all in a well-known, conventional manner. Thereafter, the stopper 20 is inserted into the neck 13 and, following this, the cap member 27 is placed on the vial, surrounding the stopper. The skirt 28 will normally be secured to the upper open end of the vial in snug relationship by heating and then forming the lower edge 26 thereof against the neck of the vial 11.

When it becomes desirable to use the medication, the vial 11 is gripped within the hand so that the thumb can press against the upper end wall 36 of the cup 29. By urging the cup 29 toward the vial 11 with the thumb, the cup will first move relative to the ring 33 whereby the web 37 is fractured. Thereafter, subsequent downward movement of the cup 29 causes its lower edge 31 to engage the upper surface of shoulder 30 after which continued downward movement of the cup 29 causes the stopper to move further into the vial 11. Such movement of the stopper creates hydraulic pressure within the upper compartment 16, which forces the plug 18 out of the constriction 17 so that the solvent can flow into the lower compartment 14 and mix with the medication.

In this embodiment, the force required to fracture the web 37 and the force required to move the stopper 20 further into the vial 11 are applied sequentially, thereby minimizing the amount of force applied at any given time during the manual urging of the cup 29 and stopper 20 into the vial.

The cup 29 can then be removed from the upper portion 34 of the stopper 20 after which the syringe needle 23 is inserted through the stopper 20, the recess 22 and into the upper compartment 16 of the vial from which the dissolved medication is then removed while the vial is in an inverted position. The syringe can then be removed from the stopper 20 and the self-sealing nature of the stopper will prevent leakage, if some medication remains. If desired, the cup 29 can then be returned to the position covering the upper portion 34 of the stopper.

Figure 8:
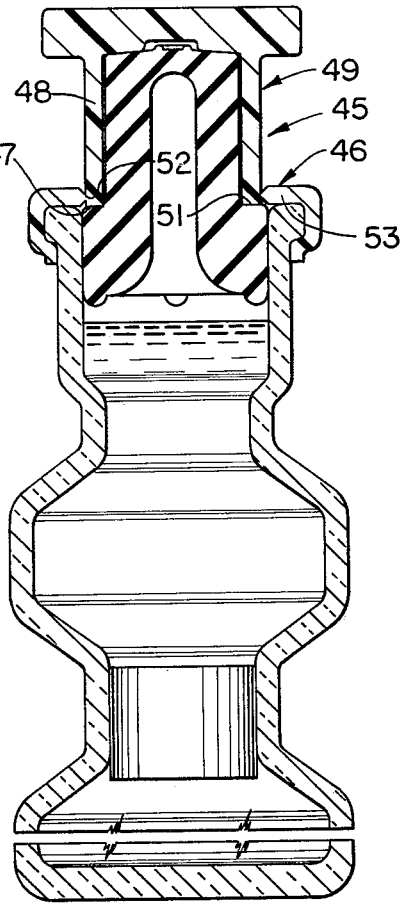
FIG. 8 is a fragment of FIG. 2 illustrating a modified cap member.

FIG. 8 illustrates a closure 45 having a cap member 46 which is a modification of the cap member 27 in FIGS. 1 and 2. Specifically, the lower edge 47 of the side wall 48 of the cup 49 bears against the shoulder 51 of the stopper 20 when the closure is assembled upon the vial 11. Thus, the web 52 is fractured as the stopper 20 is moved downwardly with the cup 49. Also, the web 52 is located approximately midway between the upper and lower surfaces of the ring 53.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a two-compartment container having a constriction between the two compartments capable of receiving a removable plug which provides a liquid-tight barrier between the two compartments, said container having a neck communicating with one of said compartments and said neck having an annular rim adjacent the free end thereof, and a closure structure for the neck, the closure structure comprising:

a resiliently flexible, substantially cylindrical stopper having a first portion with an outside diameter slightly larger than the inside diameter of said neck and snugly receivable into said neck and a second portion of reduced diameter projecting beyond the free end of said neck;

resiliently flexible cap means of substantially circular cross section having a fastening portion telescopically receivable onto the free end of said neck, said fastening portion having means for gripping said rim, said fastening portion including means overlying the upper edge of the stopper first portion so as to oppose its removal from the container, and said cap means having a sleeve portion of reduced diameter snugly but slidably receivable onto the second portion of said stopper, said sleeve portion being attached to said fastening portion by manually fracturable means, said sleeve portion being slidably receivable with the second portion of said stopper into said neck by the application of force urging said sleeve portion toward said container; and means attached to said outer end of said sleeve portion of said cap means for closing the outer end thereof.

2. In a two-compartment container having a constriction between the two compartments capable of receiving a removable plug which provides a liquid-tight barrier between the two compartments, said container having a neck communicating with one of said compartments and said neck having a radially outwardly projecting and annular rim adjacent the free end thereof, a closure structure for the neck, the closure structure comprising:

a resiliently flexible, substantially cylindrical stopper having a first portion with an outside diameter slightly larger than the inside diameter of said neck and snugly receivable into said neck and a second portion of reduced diameter projecting beyond the free end of said neck and thereby forming a shoulder between said first and second portions; and resiliently flexible cap means of substantially circular cross section having a fastening portion telescopically receivable onto and over the free end of said neck, said fastening portion having opposing means for gripping said rim, the opposing means remote from said constriction extending radially inwardly for engagement by the shoulder to oppose the discharge of said first portion from said neck, said cap means having an inverted cup portion of reduced diameter including a substantially cylindrical side wall slidably receivable onto the second portion of said stopper and extending axially slightly beyond the outer end of said stopper, said cup portion of said cap means being attached to said fastening portion by manually fracturable means connected to the inner edge of the fastening portion and the lower edge of the cup portion, said lower edge being spaced from said shoulder and being engageable therewith for urging said stopper toward said constriction, and said cup portion being slidably receivable with the second portion of said stopper into said neck by the application of force urging said cup portion toward said container.

3. A closure structure according to claim 1 or claim 2, wherein the fastening portion of said cap means includes an annular member connected to the adjacent lower edge of said cup portion by said fracturable means; and said fracturable means is a thin web of the same material comprising said cap means.

4. A closure structure according to claim 3, wherein said web lies substantially between two closely spaced planes, one being substantially defined by the axial surface of said shoulder and the other being substantially defined by the inner end of said cup portion; and wherein the shoulder of said stopper is spaced from the inner end of said cup portion so that movement of said cup portion toward said container first fractures said web and then urges said stopper toward said constriction.

5. In combination, a two-compartment mixing vial having a constriction between the two compartments, removable plug disposed within the constriction to provide a liquid-tight barrier between the two compartments, said vial having a neck at on end thereof for defining an opening communicating with one of said compartments, said neck defining an annular rim adjacent the free end thereof in surrounding relationship to said opening, and a closure structure attached to said vial for closing the opening in said neck, said closure structure including a substantially cylindrical stopper disposed within said neck, said stopper comprising a resiliently flexible member having a first substantially cylindrical portion with an outside diameter slightly larger than the inside diameter of said neck and snugly receivable into said neck and a second portion of reduced diameter projecting outwardly beyond the free end of said neck and thereby forming a shoulder at the junction between said first and second portions, comprising the improvement wherein said closure structure includes:

cap means having a fastening portion telescopically received onto and over the free end of said neck, said fastening portion having a first part for grippingly engaging said rim and a second part extending radially inwardly beyond the upper free edge of said neck for engagement by said shoulder to oppose the removal of said first stopper portion from said neck;

said cap means also having a sleeve portion of reduced diameter snugly but slidably receivable onto the second portion of said stopper, said sleeve portion having the lower edge thereof disposed opposite but spaced upwardly from said shoulder;

said cap means further including manually fracturable means connected between said sleeve portion and said second part, said manually fracturable means being connected to said sleeve portion in the vicinity of the lower edge thereof, the application of a downward force on said sleeve portion initially causing breaking of said fracturable means so that said sleeve portion is movable downwardly for engaging the shoulder on said stopper for urging said stopper toward said constriction, said sleeve portion being slidably receivable with said second stopper portion into said neck when pushed downwardly following breakage of said fracturable means.

6. A combination according to claim 5, wherein said cap means comprises an integral one-piece member.

7. A combination according to claim 5, wherein said first part of said fastening portion comprises an annular ringlike part disposed in snug surrounding relationship to said annular rim, said second part comprising an annular platelike member connected to said ringlike part and projecting radially inwardly thereform so as to overlie the axial free end of said neck, said annular member having an inner diameter smaller than the diameter of the opening defined by said neck so that the radially inner edge of said annular member overlies said shoulder, said sleeve portion having an outer diameter adjacent the lower end thereof which is at least of slightly smaller diameter than the inner diameter of said annular member so that said sleeve portion can axially slidably pass through said annular member into said neck, and said manually fracturable means being connected between said sleeve portion and said annular member adjacent the inner diameter thereof.

8. A combination according to claim 7, wherein said cap means is constructed as an integral one-piece member.

9. A combination according to claim 8, wherein said manually fracturable means includes a plurality of thin angularly spaced webs connected radially between the outer periphery of said sleeve portion and the radially inner edge of said annular member.

10. A combination according to claim 7, wherein the annular rim on said vial includes a radially outwardly projecting annular flange, and wherein the first of said fastening portion includes means which extend radially inwardly beneath said annular flange to mechanically lock said cap means to said vial.

11. A combination according to claim 7, wherein said manually fracturable means includes a plurality of thin angularly spaced webs connected radially between the outer periphery of said sleeve portion and the radially inner edge of said annular member.

12. A combination according to claim 7, wherein the manually fracturable means is connected to said annular member at a location spaced upwardly from the lower surface thereof.

* * * * *